United States Patent [19]

Reichelt et al.

[11] Patent Number: 4,721,152

[45] Date of Patent: Jan. 26, 1988

[54] APPARATUS FOR CONTINUOUS CASTING

[75] Inventors: Wolfgang Reichelt, Moers; Klaus Schwerdtfeger, Goslar; Peter Voss-Spilker, Kempen, all of Fed. Rep. of Germany

[73] Assignee: Mannesmann AG, Duesseldorf, Fed. Rep. of Germany

[21] Appl. No.: 928,734

[22] Filed: Nov. 7, 1986

Related U.S. Application Data

[63] Continuation of Ser. No. 750,420, Jun. 28, 1985, abandoned.

[30] Foreign Application Priority Data

Jun. 28, 1984 [DE] Fed. Rep. of Germany ..... 3423834

[51] Int. Cl.[4] ..... B22D 11/06; B22D 11/10

[52] U.S. Cl. ..... 164/429; 164/437; 164/443

[58] Field of Search ..... 164/423, 429, 437, 443, 164/463, 479, 485, 488, 489, 436; 222/590, 591, 594, 597, 598

[56] References Cited

U.S. PATENT DOCUMENTS

| | | | |
|---|---|---|---|
| 2,210,145 | 8/1940 | DeBats | 164/429 X |
| 4,221,257 | 9/1980 | Narasimhan | 164/429 X |
| 4,245,692 | 1/1981 | Hargassner et al. | 164/436 |
| 4,274,473 | 6/1981 | Bedell et al. | 164/423 |

FOREIGN PATENT DOCUMENTS

| | | | |
|---|---|---|---|
| 0081117 | 6/1983 | European Pat. Off. | 164/463 |

*Primary Examiner*—Nicholas P. Godici
*Assistant Examiner*—J. Reed Batten, Jr.
*Attorney, Agent, or Firm*—Ralf H. Siegemund

[57] ABSTRACT

An apparatus for continuously casting metal for obtaining a substantially flat casting includes a vessel having a bottom opening defined by side walls and by a rear wall and a tiltable front wall, the rear and front walls ending at different levels so that the bottom opening has a horizontal as well as a vertical component; a planar metal, endless belt is disposed underneath the opening and defines a casting gap together with the front wall, the more downwardly extending rear wall in conjunction with that casting gap deflects casting material from a down flow directly into the horizontal; a meniscus seals the rear wall against the belt; the belt is spray cooled from below.

5 Claims, 2 Drawing Figures

APPARATUS FOR CONTINUOUS CASTING

CROSS-REFERENCE TO RELATED APPLICATION

This is a continuation of application Ser. No. 750,420 filed June 28, 1985 and now abandoned.

BACKGROUND OF THE INVENTION

The present invention relates to continuous casting of metal particularly steel under utilization of a container; a mold or a moldlike metallurgical vessel being open at the bottom and from which casting is withdrawn under immediate and direct cooling in order to obtain rapid solidification. More particularly the invention relates to the continuous casting of metal under utilization of a casting process by means of which the casting is withdrawn from a mold or other vessel in a horizontal direction.

Castings made by means of process and equipment of the type to which the invention pertains are usually of a flat nature and refer to the making of metal plate or strip. The object is to provide a blank which can subsequently be rolled down in order to obtain metal sheet with as little deformation as possible. Rolling may be carried out either in a hot or a cold working process. In case or hot rolling the casting has a thickness of about 25 to 40 mm whereas in case of cold rolling the casting should be only as thin as 2–8 mm. Typically, the width of the metal strip plate or sheet stock is about 2000 mm.

The state-of-the-art as evidenced by "Handbuch des Stranggiessens", Dr. Erhard Herrmann, Alluminium-Verlag GmbH, Duesseldorf, 1958, Page 29, Note 48, alludes to casting of molten metal wherein the metal is poured onto one end of a partially heated and partially cooled table. As a result a strip is immediately formed into sheet stock by means of pairs of rolls arranged at the other end of the table. This method basically originated in 1907 in order to cast metal such as lead, tin, zinc, or alloys thereof. In 1908 this method was improved by replacing the stationary table by an endless belt (FIG. 61, 62) so as to avoid tearing of the striplike sheet stock prior to complete solidification. The sheet will be placed onto a stationary table only after having adequately and sufficiently solidified, and the sheet stock is then fed to the roll gap from that table.

Another method is known for continuous casting of metals under utilization of a container being open at the bottom by using two casting wheels which constitute the mold and the metal is poured directly in between the two wheels. Still another method is to pour molten metal in between two juxtaposed casting bands under lateral limitation of the casting cross section. The bands are suitably grooved and the process is also a continuous one. However, the known method using casting wheels and casting ribbons are disadvantaged by the fact that the casting process itself depends on the metallostatic or ferrostatic pressure of the metal column and on the configuration of the discharge opening of the vessel which pours the metal into the casting space between tapes, bands or wheels. It was found that adequately controlling the thickness of the casting is complicated or even impossible. Moreover, these methods are disadvantaged by the fact that changes in thickness for different castings is likewise endowed with significant problems and close to being impossible.

SUMMARY OF THE INVENTION

It is an object of the present invention to provide a new and improved method and equipment for continuous casting of metal which permits on one hand the casting of thin castings but in which variations in thickness are made possible independent from the various casting parameters.

In accordance with the preferred embodiment of the present invention it is suggested to provide a moldlike container with an opening in the bottom having a wall opposite the direction of horizontal withdrawal of the casting while a plain metal strip or belt of high thermal conductivity is moved horizontally underneath the opening and in the direction of casting withdrawal whereby the space between the container and the metal strip or belt is used to adjust the thickness for the basically flat casting. This process and equipment does not introduce any problem at the critical function point established between container and moved metal strip, because as the casting flow is deflected when flowing from the container onto the belt or strip, a meniscus forms out of the molten metal, between the rear wall of the container and the belt or strip, so that particular sealing thereat is not necessary. Thickness adjustment as far as the casting itself is concerned is preferably carried out by adjustment of the front wall of the container opposite the deflecting and meniscus established by the rear wall.

The throughput i.e. quantity/time of flowing molten metal should be subjected to some inherent limitation given by the overall effective cross section of the opening in the container. No problem exists with regard to controlling the withdrawal and casting speed because the inventive improvement is to be seen in particular in the fact that the casting speed is determined by the speed of moving the flat metal casting by means of the belt and by the heat dissipation from the casting particularly into the belt, ribbon or strip. The casting speed can be controlled additionally for metallurgical reasons by controlling an adjustment of the metallostatic (e.g. ferrostatic) pressure in the container which is established by adjusting the level and degree of filling of the casting container.

In furtherance of carrying out the invention the container should have in its underside a discharge opening whose width establishes the width of the cast strip. Withdrawal rolls extend along the widthdrawal path and right under the opening of the container including particularly the rear wall thereof above which the meniscus forms. These rolls on rollers move the endless casting belt. Cooling is carried out by spray cooling the casting belt, using nozzles for spraying coolant such as water in the gaps between the support and withdrawal rollers.

The volume of the mold defining container is rather substantial and having relatively small discharge opening so that even in case of a relatively low metallostatic height sufficient molten metal is available to maintain the continuity of the casting.

The front wall of the container is adjusted as to its height and level above the casting strip for purposes of adjusting the thickness of the cast ingot. Preferably that wall is tiltable and the lower edge determines the width and level above the casting belt. The separation between hot and cool side of the casting process is facilitated by the particular mode of cooling and the belt has preferably a very high thermal conductivity A short heat transport path from the surface of the casting to the cooled water will be facilitated by choosing as thin a transport belt as possible, a belt thickness in the range of 1–2 mm is preferred. A smaller thickness may pose mechanical problems, a thicker belt is not necessary and reduces the effective heat transport.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
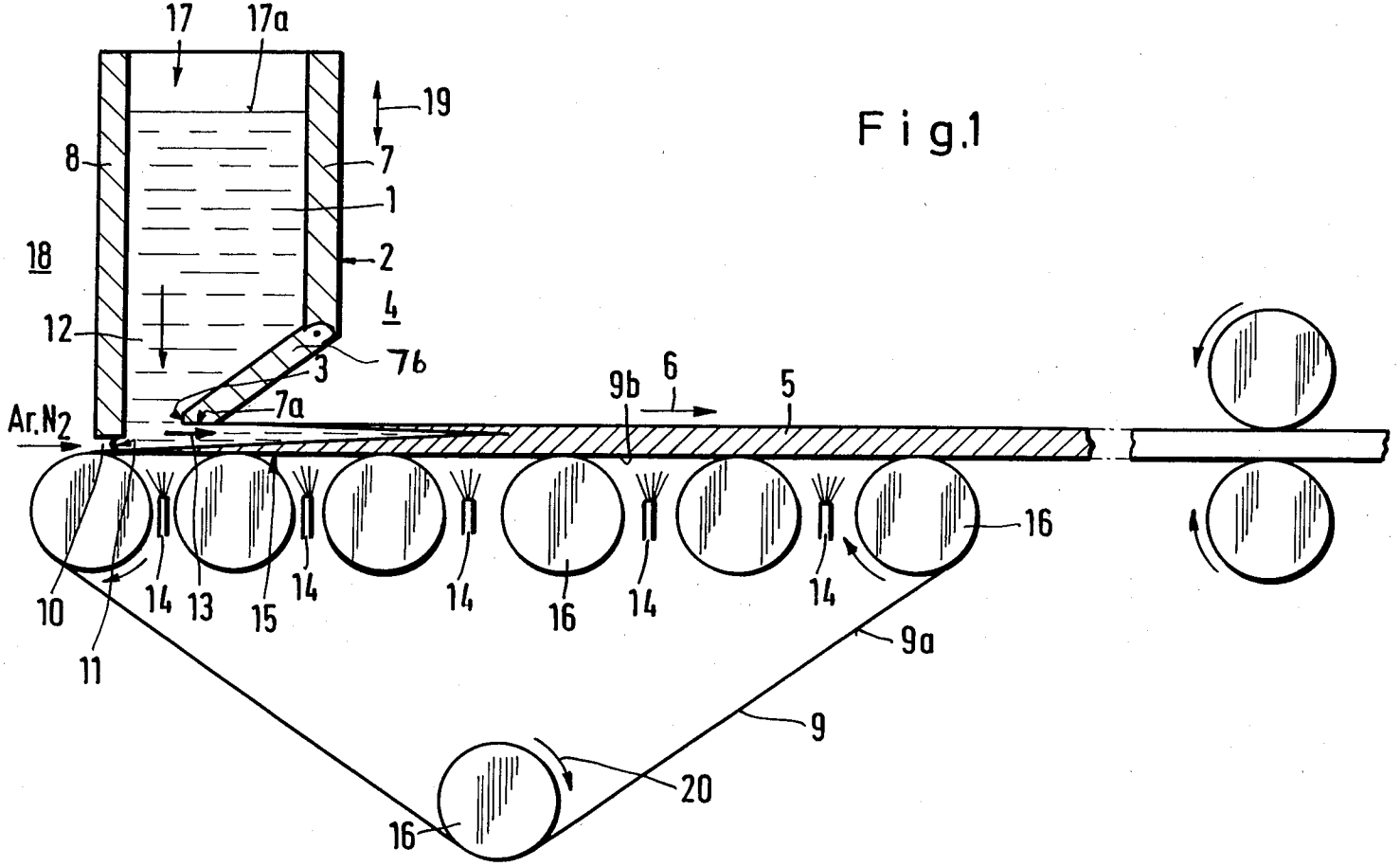
FIG. 1 is a longitudinal section view through an apparatus in accordance with the preferred embodiment of the present invention for practicing the best mode thereof.
Figure 2:
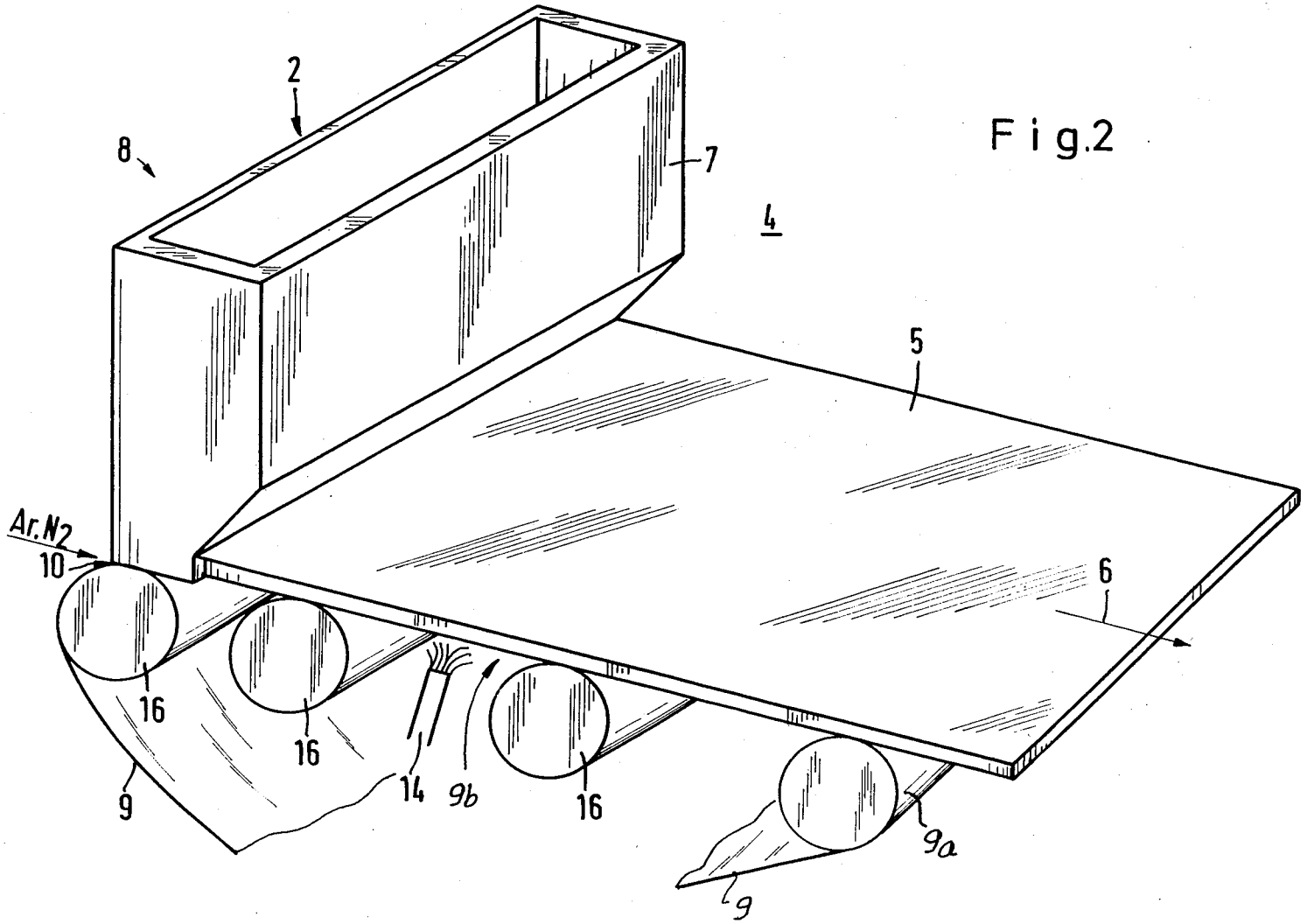
FIG. 2 is a perspective side view of the equipment shown in FIG. 1.

Proceeding now to the detailed description of the drawings molten metal such as steel and having the requisite casting temperature is maintained in a particular container mold, or casting vessel 2 having a bottom opening 3. Reference numeral 4 generally denotes the front side which is the side on which the casting and withdrawal of the casting occurs. Reference numeral 18 corresponds to rear side of that arrangement. The vessel itself is comprised of a rear wall 8, a front wall 7, and side walls shown only in FIG. 2. Reference numeral 5 refers to the casting itself being withdrawn in direction of arrow 6.

The rear wall 8 establishes a moving gap 10 together with the casting strip 9 which is an endless belt. That belt runs in the horizontal and between it and the bottom edge *7a* of the front wall 7 establishes an opening through which the casting 5 is withdrawn or one can say that the molten metal in the vessel 2 generally flows down inside the vessel as indicated by the arrow 12, and the rear wall 8 deflects that flow into the horizontal as indicated by arrow 13.

The gap 10 is closed by the meniscus 11. The surface tension of the molten metal establishes a free boundary between wall 8 and the casting belt 9 thereby closing effectively the gap 10 without impeding the motion of the belt 9. The gap 10 is approximately 0.2–1.0 mm wide (high) and, as indicated, a gas jet may be directed towards the meniscus 11 so as to establish a veil of inert gas, the gas may be Ar or N. The dynamic pressure of that gas aids in the formation of the meniscus.

The belt 9 has an upper side *9a* which, as stated, runs in the horizontal, and the underside *9b* of the belt is cooled by means of water jets emitted by nozzles 14. The heat transfer in the direction of cooling should be larger than the heat flow of the metal as it is moved. Thus the temperature of belt 9 will remain at the level of the cooling medium. The front wall 7 at the withdrawal side 4 determines as stated with its lower end *7a* the casting thickness defining space and distance 15.

The endless belt 9 runs over a plurality of horizontally arranged support rolls or rollers 16 which are basically provided for carrying the weight of the casting 5. The rolls 16 are spaced such that between the respective two rolls and corresponding to the tension of the support belt 9 a horizontal support surface is consistently defined alng the upper side *9a* of the belt. The belt could have a very acute angle relative to the horizontal to establish a light downward slant of the transport path. The belt moreover is run in addition by means of one of the rolls 16 being a tension roll. One of the rolls 16 is motor driven, several rolls could be motor driven but not all have to be driven but can run as idlers.

The driven roll imparts upon the metal belt 9 a speed which corresponding to the heat transfer capabilities of the belt under consideration of its flexibility corresponds exactly to the casting speed. As stated, the casting speed can be controlled in addition through selection and control of the bath level *17a* to thereby vary and control the metallostatic i.e. ferrostatic elevation of the metal and being measured down from the level *17a*. However it is pointed out that the level 17a is not the principal criterion for controlling the casting speed, rather the dynamics of the molten metal 1 in conjunction with the opening 3 and the dynamics i.e. movement of the belt 9 are all factors which together determine the casting speed whereby the deflection of the metal flow from a vertical component 12 into the horizontal 13 constitutes a certain automatic control feature.

As stated the lower side *7a* of the front wall 7 establishes a discharge opening 15 to thereby determine the width of the casting. The wall 7 has actually a slanted and preferably hinged portion *7b* to vary the cross section of the container 2. Generally speaking the opening 3 of vessel 2 has a vertical as well as a horizontal component as can readily be seen from the drawings a lower edge portion, *7a*, of the hinged portion *7b* is slanted such that it extends in the horizontal or at least substantially horizontal visa-vis the casting belt *9a*. Moreover, the hinged portion *7b* slants inwardly so that the cross section of the casting vessel is reduced in down direction i.e. towards the opening 3. This is established by different downward extensions of walls 7 and 8. The horizontal component is of course established by the horizontal spacing of wall end *7a* from the rear wall 8. The end *7a* of the wall 7 determines the vertical component of opening 15 vis-a-vis the plane *9a* of the casting belt to thereby determine the thickness 15 of the casting. The level of the end wall 8 above belt 9 just clears the moving belt and the mold of container 2. This is generally equivalent to the operation of a mold for continuous casting. It is possible as indicated by the double arrow 19 to adjust in addition this gap 15 by lowering or raising the wall 7.

The belt 9 is to have a high thermal conductivity and its heat transfer capability together with the flexibility permits a tension force to be transmitted upon the casting. The gap 10 between the rear wall 8 of the container 2 and belt 9 should be adjusted during casting of steel to be about 0.2 mm. At the most it should be 1.0 mm but that depends on temperature and surface tension of the material for purposes of ensuring the formation of a stable meniscus 11.

The invention is not limited to the embodiments described above but all changes and modifications thereof, not constituting departures from the spirit and scope of the invention, are intended to be included.

We claim:

1. Apparatus for continuously casting steel for obtaining a substantially flat casting comprising:

a vessel having a bottom opening defined by side walls and by a rear wall and a front wall;

a moving planar metal belt disposed underneath said opening and defining a casting gap together with said front wall, the rear wall extending more downwardly than the front wall, to about 0.2 to 1.0 mm from the belt; and the rear and front walls of the vessel ending at different levels so that the bottom opening has a horizontal as well as a vertical component, said front wall having an inwardly extending hinged portion with a lower edge which is slanted such that it is substantially parallel to the surface of the belt the hinged portion being adjustable to vary the vertical component of said opening.

2. Apparatus as in claim 1 there being a small gap between said rear wall and said belt being enclosed by the formation of a miniscus.

3. Apparatus as in claim 1 including means for spray cooling said belt from underneath.

4. Apparatus as in claim 1 wherein said belt is of high conductivity and having a thickness from 1–2 mm.

5. Apparatus as in claim 1 said belt being of endless configuration there being a plurality of support rolls for supporting said belt, at least one of the rolls being driven.

* * * * *